US008424356B2

(12) United States Patent
Tanabe et al.

(10) Patent No.: US 8,424,356 B2
(45) Date of Patent: Apr. 23, 2013

(54) DEEP-DRAWING DEVICE

(75) Inventors: Ikuo Tanabe, Niigata (JP); Hiroyuki Sugai, Niigata (JP)

(73) Assignee: Nagaoka University of Technology, Niigata (JP)

( * ) Notice: Subject to any disclaimer, the term of this patent is extended or adjusted under 35 U.S.C. 154(b) by 300 days.

(21) Appl. No.: 12/448,941

(22) PCT Filed: Jan. 10, 2008

(86) PCT No.: PCT/JP2008/050205

§ 371 (c)(1),
(2), (4) Date: Nov. 5, 2009

(87) PCT Pub. No.: WO2008/087888

PCT Pub. Date: Jul. 24, 2008

(65) Prior Publication Data

US 2010/0116015 A1 May 13, 2010

(30) Foreign Application Priority Data

Jan. 17, 2007 (JP) ..... 2007-007695

(51) Int. Cl.
*B21D 37/16* (2006.01)

(52) U.S. Cl.
USPC ..... 72/342.5; 72/342.6; 72/342.94; 72/347

(58) Field of Classification Search ..... 72/342.3, 72/342.7, 342.8, 342.92, 349, 342.6, 347
See application file for complete search history.

(56) References Cited

U.S. PATENT DOCUMENTS

| | | | | |
|---|---|---|---|---|
| 3,340,714 | A * | 9/1967 | Pohl et al. | 72/342.4 |
| 5,181,409 | A * | 1/1993 | Heyes et al. | 72/46 |
| 6,263,718 | B1 * | 7/2001 | Buse et al. | 72/342.92 |
| 6,550,302 | B1 * | 4/2003 | Ghosh | 72/342.8 |
| 6,742,374 | B2 * | 6/2004 | Ozawa | 72/342.5 |
| 7,191,632 | B2 * | 3/2007 | Kanehara et al. | 72/342.8 |
| 7,204,119 | B2 * | 4/2007 | Kruger et al. | 72/342.7 |
| 8,118,954 | B2 * | 2/2012 | Beenken et al. | 148/714 |

FOREIGN PATENT DOCUMENTS

| | | |
|---|---|---|
| JP | 02-099226 A | 4/1990 |
| JP | 05-237558 A | 9/1993 |

(Continued)

OTHER PUBLICATIONS

International Search Report mailed on Mar. 18, 2008.

*Primary Examiner* — David B Jones
(74) *Attorney, Agent, or Firm* — Rader, Fishman & Grauer PLLC

(57) ABSTRACT

A deep drawing apparatus is provided in which a sheet material is subjected to optimal heating and cooling, whereby the limiting draw ratio is increased and a product can be worked more deeply, and uniformity of the sheet thickness of the product can be controlled. This apparatus includes: a punch 2 for subjecting a sheet material 9 to deep drawing; a die 3, used along with the punch, for forming the sheet material and subject the same to deep drawing; an anti-wrinkling component 4 for preventing wrinkling around the periphery of the forming portion in the sheet material; an induction heating coil 5 for directly heating the sheet material at a portion supported by the anti-wrinkling component; a heating controller 6 for controlling the amount of heating of the sheet material by the induction heating coil; and cooling means 21 to 23 for cooling the sheet material at the portion formed by the punch.

16 Claims, 2 Drawing Sheets

FOREIGN PATENT DOCUMENTS

| | | | |
|---|---|---|---|
| JP | 11-309519 | A | 11/1999 |
| JP | 2002-096121 | A | 4/2002 |
| JP | 2005-169394 | A | 6/2005 |
| JP | 2006-192480 | A | 7/2006 |

* cited by examiner

DEEP-DRAWING DEVICE

TECHNICAL FIELD

The present invention relates to a deep drawing apparatus used to subject a sheet material to deep drawing, and more particularly relates to a deep drawing apparatus with which a sheet material is subjected to optimal heating and cooling, whereby the limiting draw ratio is increased and a product can be worked more deeply, and uniformity of the sheet thickness of the product can be controlled.

BACKGROUND ART

In deep drawing, being able to work a product more deeply translates to higher product value. The limiting draw ratio is an index indicating the possible working depth in deep drawing. The limiting draw ratio is the ratio D/d of the raw sheet material diameter D to the limiting product diameter d that can be worked. The limiting draw ratio needs to be increased to that products can be worked more deeply. To this end, there is a warm deep drawing method in which the sheet material is heated to increase its ductility and allow a more deeply worked product to be obtained. A known example of this working technique is the following Patent Document 1. Patent Document 1 states that a sheet material is heated with an electric heater prior to performing deep drawing. The cooling of the sheet material during working is also discussed.

Patent Document 1: Japanese Patent Application Laid-Open No. H5-237558

With a technique such as that in Patent Document 1, since the sheet material is heated by electric heater from outside the sheet material, there is a considerable time lag until the sheet material is heated to the required temperature all the way through in its thickness direction. Therefore, problems that are encountered are that heating control over the sheet material is less precise, as are the shape of the final product and the sheet thickness. There is a need to be able to increase the workable depth without causing this loss of precision.

DISCLOSURE OF THE INVENTION

In view of this, it is an object of the present invention to provide a deep drawing apparatus with which a sheet material is subjected to optimal heating and cooling, so that the limiting draw ratio is increased and a product can be worked more deeply, and uniformity of the sheet thickness of the product can be controlled.

To achieve the stated object, the deep drawing apparatus of the present invention includes: a punch for subjecting a sheet material to deep drawing; a die, used along with the punch, for forming the sheet material and subject the same to deep drawing; an anti-wrinkling component for preventing wrinkling around the periphery of the forming portion in the sheet material; an induction heating coil for directly heating the sheet material at the portion supported by the anti-wrinkling component; a heating controller for controlling an amount of heating of the sheet material by the induction heating coil; and cooling means for cooling the sheet material at the portion to be formed by the punch.

Also, with this deep drawing apparatus, it is preferable if the heating controller uses the output of the induction heating coil at the start of deep drawing as a predetermined starting output, and reduces the output of the induction heating coil as the drawing proceeds.

Also, with this deep drawing apparatus, it is preferable if the heating controller reduces the output of the induction heating coil stepwise from the starting output as the drawing proceeds.

Also, with this deep drawing apparatus, it is preferable if the cooling means comprise a coolant channel formed inside the punch, a coolant reservoir formed between the sheet material and the side face part of the punch, and cooling face adjusting means for adjusting the level of the coolant held in the coolant reservoir.

Also, with this deep drawing apparatus, it is preferable if the cooling face adjusting means comprises a position-adjustable cooling face adjusting nozzle for suctioning coolant.

Because it is constituted as above, the present invention affords the following effects.

Heating the sheet material increases its ductility and raises the limiting draw ratio, so the product can be worked more deeply. Heating the sheet material with an induction heating coil affords good heating efficiency and reduces the energy needed for heating. Also, heating response is quicker, and changes to the heating amount can be controlled more quickly and more precisely.

Reducing the output of the induction heating coil as the working proceeds makes the sheet thickness more uniform on the side face part of the deep drawn product.

Reducing the output of the induction heating coil stepwise as the working proceeds allows the sheet thickness to be made more uniform on the side face part of the deep drawn product by a simple control.

Since a coolant is brought directly into contact with the sheet material to cool it by the heat of evaporation, the sheet material cooling efficiency is extremely high. Also, since the sheet material cooling position can be adjusted, optimal cooling can be performed according to the type of product. Furthermore, the sheet material cooling position remains constant regardless of how far the punch has progressed, so the portion of the sheet material at the punch side face part can be cooled thoroughly, without missing any places.

Using a position-adjustable cooling face adjusting nozzle to suction coolant allows the cooling position to be adjusted simply and reliably.

EXPLANATION OF REFERENCE NUMERALS

Figure 1:
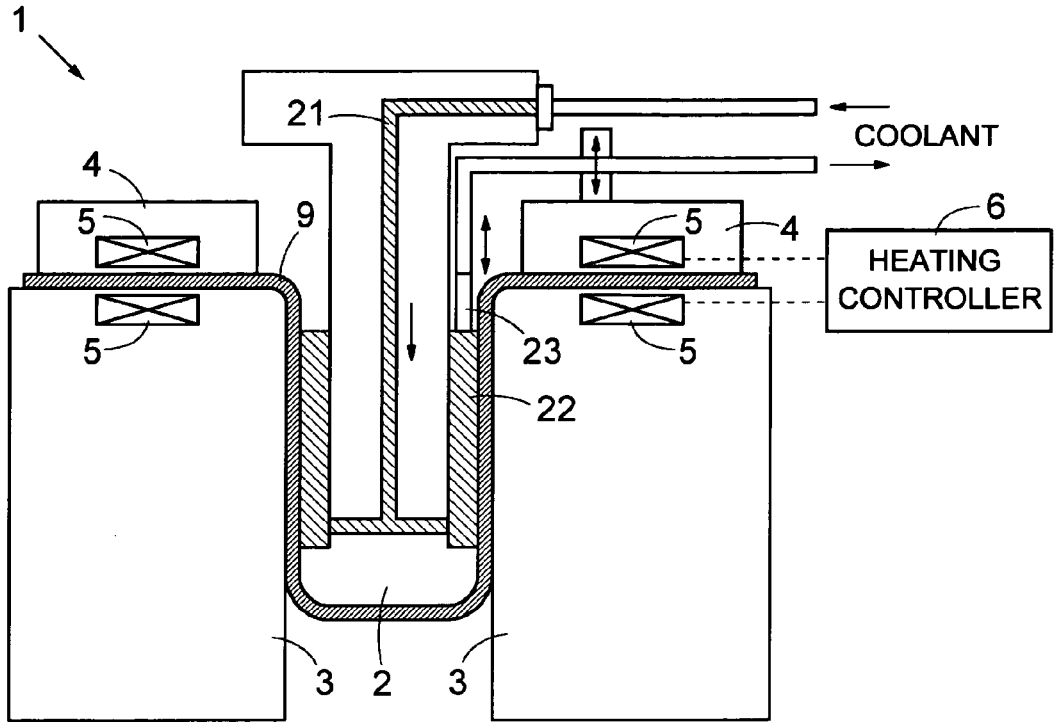
FIG. 1 is a simplified diagram of the configuration of the main components of the deep drawing apparatus 1 of the present invention.

1 deep drawing apparatus
2 punch
3 die
4 anti-wrinkling component
5 induction heating coil
6 heating controller
9 sheet material
21 channel
22 coolant reservoir
23 cooling face adjusting nozzle

BEST MODE FOR CARRYING OUT THE INVENTION

An embodiment of the present invention will now be described through reference to the drawings. FIG. 1 is a simplified diagram of the configuration of the main components of the deep drawing apparatus 1 of the present invention. A punch 2 and a die 3 are attached to a press (not shown). The punch 2 is attached to a ram that is moved up and down by a hydraulic unit, and as shown in the drawings, a sheet material 9 placed on the die 3 is subjected to deep drawing by pushing the punch 2 into the die 3. The anti-wrinkling component 4 is installed to prevent wrinkling around the formed periphery of the sheet material 9.

An induction heating coil 5 is embedded on the lower face side of the anti-wrinkling component 4 and the upper face side of the die 3. The induction heating coil 5 is provided all the way around the formed periphery of the sheet material 9. The induction heating coil 5 directly heats the sheet material 9 from the inside by eddy current induced by electromagnetic induction. The heating of the sheet material 9 by the induction heating coil 5 affords better heating efficiency and greatly increases the heating response rate, and when changes in the amount of heating are controlled, the control precision can be greatly improved. A heating controller 6 controls the intensity of the alternating current flowing to the induction heating coil 5, and controls changes in the amount of heating of the sheet material 9.

Thus heating the sheet material 9 enhances the ductility of the sheet material 9, increases the limiting draw ratio, and allows the product to be worked more deeply. The heating of the sheet material 9 by the induction heating coil 5 affords a reduction in energy consumption required for heating due to its better heating efficiency. Also, the heating response is quicker, and changes to the heating amount can be controlled more quickly and more precisely.

Also, cooling the portion of the sheet material 9 at the side face part of the punch 2 during deep drawing increases the yield stress of the sheet material 9, increases the limiting draw ratio, and allows the product to be worked more deeply. With the present invention, cooling means are provided for cooling the sheet material 9 at the side face part of the punch 2. A channel 21 is formed inside the punch 2 for supplying coolant. Also, a recess is formed at the side face outer peripheral part of the punch 2 so as to constitute, a coolant reservoir 22 between the punch 2 and the sheet material 9. The channel 21 communicates with the coolant reservoir 22, and supplies coolant to the coolant reservoir 22.

The coolant supplied to the coolant reservoir 22 comes into direct contact with the sheet material 9, and the sheet material 9 is efficiently cooled by the heat of evaporation. Cooling water, cooling oil, or another such cooling liquid, or a misted cooling liquid can be used as the coolant. The level of the coolant held in the coolant reservoir 22 can be adjusted by a cooling face adjusting nozzle 23. The cooling face adjusting nozzle 23 is fixed to the anti-wrinkling component 4 so that its vertical position can be adjusted. The coolant is drawn in by the cooling face adjusting nozzle 23, so that the upper position of the cooling face is restricted and the coolant is circulated. As mentioned above, the sheet material 9 cooling means comprise the channel 21, the coolant reservoir 22, and the cooling face adjusting nozzle 23.

Since the coolant is brought into direct contact with the sheet material 9 to cool it by the heat of evaporation, the sheet material 9 cooling efficiency is extremely high. Also, since the cooling position of the sheet material 9 can be adjusted with the cooling face adjusting nozzle 23, optimal cooling can be performed according to the type of product. Furthermore, the sheet material 9 cooling position remains constant regardless of how far the punch 2 has progressed, so the portion of the sheet material 9 at the punch 2 side face part can be cooled thoroughly, without missing any places.

Figure 2:
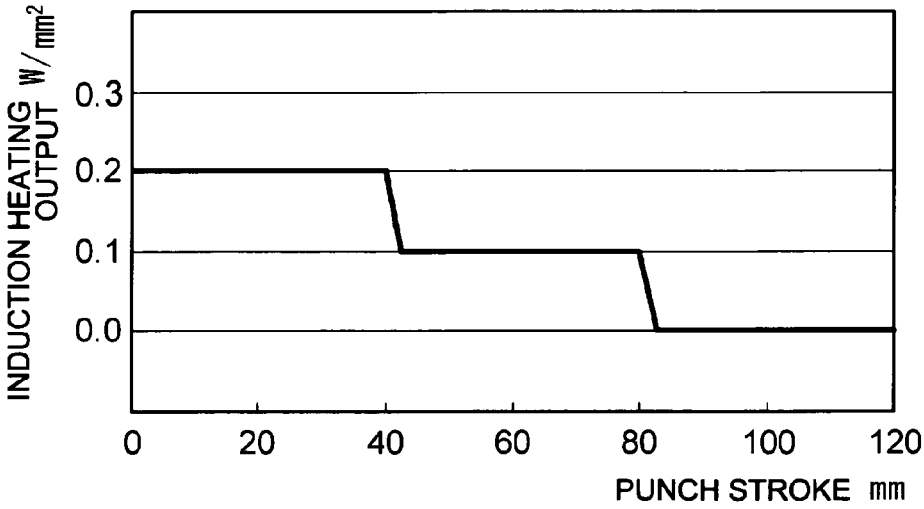
FIG. 2 is a graph of an example of the control performed by the heating controller 6.

FIG. 2 is a graph of an example of the heating control performed by the heating controller 6 and the induction heating coil 5 over the sheet material 9. The deep drawing conditions include a punch diameter of 40 mm, a punch shoulder cross sectional radius of 4 mm, a die shoulder cross sectional radius of 5 mm, a punch temperature of 25° C., a die temperature of 250° C., a punch speed of 2.5 mm/sec, a cooling face position of 0 mm (relative to the die upper face), a sheet material composed of AZ31B magnesium alloy (as designated by ASTM (American Society for Testing and Materials)), and a sheet thickness of 0.8 mm.

The horizontal axis in the graph of FIG. 2 is the stroke position (mm) of the punch 2, and the vertical axis is the heating output of the induction heating coil 5. The units of heating output are heating power per unit of surface area. As shown in FIG. 2, the maximum amount of heating is at the start of working, and the amount of heating is reduced stepwise at stroke positions of approximately 40 mm and approximately 80 mm. The heating power is assumed to be 0 above a stroke position of approximately 80 mm. Thus reducing the amount of heating stepwise makes it possible for the side face part sheet thickness to be more uniform in the deep drawn product.

Figure 3:
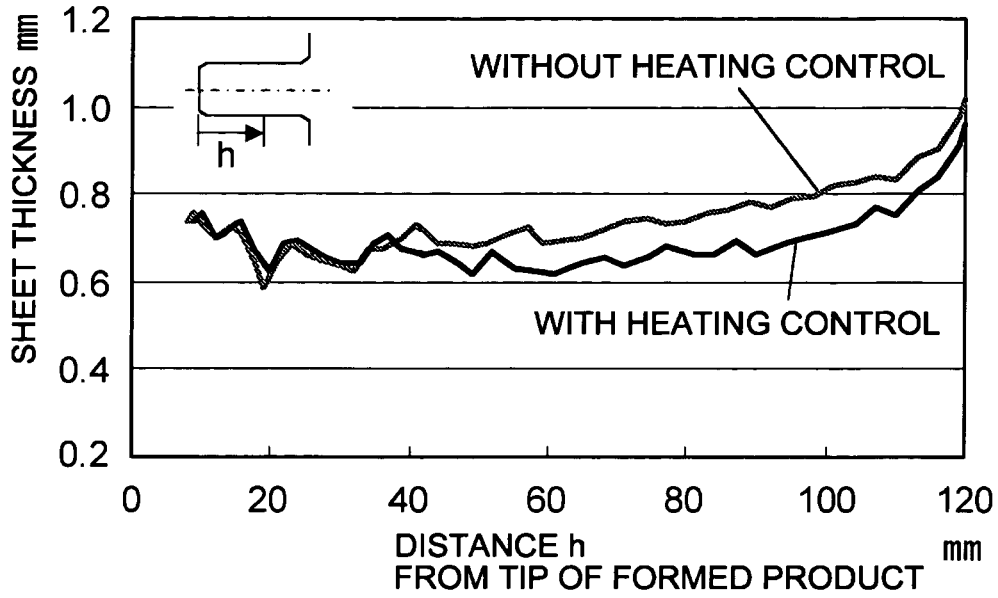
FIG. 3 is a graph of the results of comparing the side face part sheet thickness in a deep drawn product with and without heating control.

FIG. 3 is a graph of the results of comparing the side face part sheet thickness in a deep drawn product with and without heating control. The horizontal axis in the graph of FIG. 3 is the distance h (mm) from the tip of the formed product, and the vertical axis is the side face part sheet thickness (mm). The curve for "without heating control" shows the results of measuring the sheet thickness when the maximum heating at the start of working was maintained throughout the entire working process, and the curve for "with heating control" shows the results of measuring sheet thickness when the amount of heating was reduced stepwise as shown in FIG. 2. It can be seen that the uniformity of the side face part sheet thickness was better "with heating control."

Specifically, the maximum amount of heating is at the start of working, and the deformation resistance of the material is reduced to improve workability. If this is left unchanged, as with the curve for "without heating control," the side face part sheet thickness ends up gradually increasing along with the distance h, but if the amount of heating is reduced stepwise as the working progresses, the deformation resistance of the material is increased slightly, which makes the side face part sheet thickness more uniform.

Also, if the sheet material 9 is directly heated by the induction heating coil 5 and cooled by direct contact with a coolant, as with the present invention, the limiting draw ratio can be increased over that in conventional warm deep drawing. In a comparison of working the same sheet materials, the limiting draw ratio in ordinary deep drawing is about 2.8, the limiting draw ratio in conventional warm deep drawing is about 3.2, but the limiting draw ratio in the warm deep drawing of the present invention is 4.0. Thus, the present invention allows the limiting draw ratio to be increased over that in the past, and makes it possible to work a product more deeply.

As discussed above, with the present invention, the ductility of the sheet material 9 is increased by heating the sheet material 9, and the limiting draw ratio is increased, so a product that is more deeply worked can be obtained. The heating of the sheet material 9 by the induction heating coil 5 affords good heating efficiency and reduces the energy needed for heating. Also, heating response is quicker, and changes to the heating amount can be controlled more quickly and more precisely.

Furthermore, cooling the portion of the sheet material 9 at the side face part of the punch 2 during deep drawing increases the yield stress of the sheet material 9, increases the limiting draw ratio, and allows the product to be worked more deeply. Since the coolant is brought into direct contact with the sheet material 9 to cool it by the heat of evaporation, the sheet material 9 cooling efficiency is extremely high. Also, since the cooling position of the sheet material 9 can be adjusted with the cooling face adjusting nozzle 23, optimal cooling can be performed according to the type of product. Furthermore, the sheet material 9 cooling position remains constant regardless of how far the punch 2 has progressed, so the portion of the sheet material 9 at the punch 2 side face part can be cooled thoroughly, without missing any places.

FIG. 2 illustrates an example of reducing the amount of heating stepwise, but how the amount of heating is changed is not limited to reducing it stepwise, and the change may be made according to any curve desired.

INDUSTRIAL APPLICABILITY

The present invention provides a deep drawing apparatus with which a sheet material is subjected to optimal heating and cooling, so that the limiting draw ratio is increased and a product can be worked more deeply, and uniformity of the sheet thickness of the product can be controlled.

The invention claimed is:

1. A deep drawing apparatus comprising:

a die for supporting a periphery of a sheet material, a die hole being an opening into the die;

a punch insertable into said die hole and retractable from within said die hole, a stroke position being a depth of the punch in said die hole;

a heating member adjacent to said die hole for heating said periphery of the sheet material;

a control means for decreasing an amount of heating output from said heating member upon an increase of the stroke position.

2. The deep drawing apparatus according to claim 1, wherein said control means decreases said amount of heating output in stepped fashion.

3. The deep drawing apparatus according to claim 1, wherein a cooling liquid cools a forming portion of the sheet material when said punch is in said die hole.

4. The deep drawing apparatus according to claim 3, wherein said cooling liquid is from the group consisting of water, oil, a misted cooling liquid, and a coolant.

5. The deep drawing apparatus according to claim 3, wherein said forming portion of the sheet material is between said die and a recess, said recess being in a side face outer peripheral part of the punch.

6. The deep drawing apparatus according to claim 5, wherein a side face part of the punch is configured to come into contact with said forming portion of the sheet material.

7. The deep drawing apparatus according to claim 5, wherein said cooling liquid in the recess directly contacts said forming portion of the sheet material.

8. The deep drawing apparatus according to claim 5, wherein a level of said cooling liquid in said recess is adjustable.

9. The deep drawing apparatus according to claim 5, wherein a coolant channel is inside said punch, said coolant channel being configured to guide said cooling liquid to said recess.

10. The deep drawing apparatus according to claim 5, further comprising:

a nozzle configured to suction said cooling liquid from within said recess.

11. The deep drawing apparatus according to claim 10, wherein a positioning of said nozzle is adjustable.

12. The deep drawing apparatus according to claim 1, wherein said sheet material is deformable when said punch extends into said die hole.

13. The deep drawing apparatus according to claim 1, wherein said heating member is an induction heating coil.

14. The deep drawing apparatus according to claim 13, wherein eddy current heats said periphery of the sheet material, said induction heating coil being configured to induce said eddy current by electromagnetic induction.

15. The deep drawing apparatus according to claim 13, wherein a section of the heating member is embedded within said die.

16. The deep drawing apparatus according to claim 15, further comprising:

an anti-wrinkling component configured to prevent wrinkling around said periphery of the sheet material, another section of the heating member being embedded within said anti-wrinkling component.

* * * * *